US008221026B2

(12) United States Patent
Munz et al.

(10) Patent No.: US 8,221,026 B2
(45) Date of Patent: Jul. 17, 2012

(54) PAVING SCREED

(75) Inventors: Roman Munz, Neustadt (DE); Frank Grimm, Shippensburg, PA (US); Martin Buschmann, Neustadt (DE)

(73) Assignee: Joseph Vögele AG, Ludwigshafen/Rhein (DE)

( * ) Notice: Subject to any disclaimer, the term of this patent is extended or adjusted under 35 U.S.C. 154(b) by 439 days.

(21) Appl. No.: 12/435,644

(22) Filed: May 5, 2009

(65) Prior Publication Data

US 2010/0209190 A1 Aug. 19, 2010

(30) Foreign Application Priority Data

Feb. 16, 2009 (EP) ..... 09002132

(51) Int. Cl.
*E01C 19/22* (2006.01)

(52) U.S. Cl. ..... 404/96; 404/118

(58) Field of Classification Search ..... 404/84.8, 404/96, 98, 104, 118
See application file for complete search history.

(56) References Cited

U.S. PATENT DOCUMENTS

| | | | | |
|---|---|---|---|---|
| 3,992,124 | A * | 11/1976 | Schrader | 404/118 |
| 4,379,653 | A | 4/1983 | Brown | |
| 4,818,140 | A | 4/1989 | Carlson | |
| 4,969,773 | A * | 11/1990 | Heims | 404/118 |
| 4,986,695 | A * | 1/1991 | Heims | 404/118 |
| 5,203,642 | A | 4/1993 | Heller et al. | |
| 5,259,693 | A * | 11/1993 | Raymond | 404/95 |
| 5,308,190 | A * | 5/1994 | Raymond | 404/95 |
| 5,725,325 | A * | 3/1998 | Schleiter et al. | 404/118 |
| 5,924,819 | A * | 7/1999 | Breidenbach | 404/96 |
| 6,106,192 | A * | 8/2000 | Hargis et al. | 404/101 |
| 6,595,719 | B1 | 7/2003 | Ohseki et al. | |
| 7,261,491 | B2 * | 8/2007 | Rahn et al. | 404/104 |
| 2002/0106242 | A1 | 8/2002 | Rahn et al. | |
| 2002/0106243 | A1 | 8/2002 | Rahn et al. | |
| 2007/0258769 | A1 | 11/2007 | Eppes | |
| 2010/0150650 | A1 * | 6/2010 | Buschmann et al. | 404/82 |

FOREIGN PATENT DOCUMENTS

| | | | |
|---|---|---|---|
| EP | 0507258 | A1 | 10/1992 |
| JP | 07102521 | A | 4/1995 |
| JP | 11124811 | A | 5/1999 |

* cited by examiner

*Primary Examiner* — Robert Pezzuto
*Assistant Examiner* — Matthew D Troutman
(74) *Attorney, Agent, or Firm* — Fish & Richardson P.C.

(57) ABSTRACT

In a paving screed E for a road paver F, the paving screed E comprises a base screed G and extension screeds A at the front side of the base screed, the extension screeds A being extendable and retractable and pivotable relative to the base screed G, a base guiding structure 18 pivotable relative to the base screed G, a guiding sub-structure 17 slidably guided in the base guiding structure 16, an extension guiding structure 16 slidably guided in the guiding sub-structure 17, and a sole plate frame structure 14 mounted to the extension guiding structure 16 and carrying an extension screed sole plate 11, substantially vertical guidances 20 and elevation adjustment assemblies 21 between the sole plate frame structure 14 and the extension guiding structure 16, the vertical guidances 20 and the elevation adjustment assemblies 21 facilitating to adjust the elevation of the sole plate frame structure 14 and the extension screed sole plate 11 parallel to itself and relative to the extension guiding structure 16.

17 Claims, 14 Drawing Sheets

E
A
R
T
9
20
17
13
50
32
16
36
50
13
35
32
29
34
H2
Z
19
31
30
30
18
H1
7
7a
33
12
10
G

PAVING SCREED

BACKGROUND AND SUMMARY OF THE INVENTION

The invention relates to a paving screed for a road paver, the paving screed comprising a base screed and at least one extension screed which is provided at the base screed offset in a working travelling direction and which is extendable and retractable relative to the base screed in linear sliding direction, a base guiding structure for the extension screed, the base guiding structure being pivotable in a pivot suspension of the base screed, a guiding sub-structure being guided in the base guiding structure and at least a first actuator for sliding the guiding sub-structure over first stroke relative to the base guiding structure, an extension guiding structure guided in the guiding sub-structure, and at least a second actuator for sliding the extension guiding structure over a second stroke relative to the guiding sub-structure, a sole plate frame structure mounted to the extension guiding structure and having an extension screed sole plate, and vertical guidances and elevation adjustment assemblies extending substantially vertical in relation to the sliding direction, and provided between the sole plate frame structure and the extension guiding structure, for adjusting the elevation of the sole plate frame structure parallel to itself and relative to the base guiding structure.

Front-mount paving screeds having extension screeds at the front side of the base screed for being extended and retracted sidewardly in relation to the base screed to vary the working width (e.g. US 2007/0258769 A1) are used predominantly in Northern America because front-mount extension screeds provided at the front side of the base screed have advantages over rear-mounted paving screeds having the extension screeds at the rear side of the base screed, in particular when working at high working speed in working travelling direction while varying the working width and/or while forming sideways connections of drives or crossroads. A further frequently occurring requirement is to form roadbeds with a sidewardly inclined slope and/or a berm. Both, the slope and/or berm can be produced with relatively high working travelling speed if the extension screeds are mounted to the front side of the base screed. A slope e.g. has the purpose to direct rainfall water sidewardly, while a berm is a counter-slope ascending from the slope or from the road surface and e.g. serves to direct sewage water along the roadside. When forming a slope the width of the road surface (a flat road surface or a road surface having a crown profile) should remain unchanged when the working width is varied, while the width of the slope may vary.

In the front-mount paving screed known from US 2007/0258769 A1 with extension screeds mounted to the front side of the base screed, the base guiding structure is pivoted relative to the base screed in the base screed by at least one vertical actuator. The guiding sub-structure is slidably guided in the base guiding structure. The extension guiding structure, finally, is slidably guided at the guiding sub-structure. The base guiding structure, the guiding sub-structure and the extension guiding structure define a common linear sliding direction of the extension screed. The sole plate frame structure is fixedly mounted to the extension guiding structure. Alternatively the sole plate frame structure may be inclined by an auxiliary actuator in lateral direction relative to the extension guiding structure. The vertical actuator in the base screed is also used to carry out elevation adjustments of the extension screed in relation to the base screed. However, that actuator has to support all weight forces of the extension screed as well as all working forces resulting from the drag resistance of the paving material at the extension screed. In particular when the extension screed is fully extended such forces may become relatively high, which means that adjustments of the elevation of the extension screed when needed during the working process may be hindered. The double function (adjustment of the elevation and pivoting the extension screed relative to the base screed) of the vertical actuator of a pair of vertical actuators, furthermore, result in undue high local loads between the base guiding structure, the base screed and the actuator or the actuators.

In the front-mount paving screed known from U.S. Pat. No. 4,379,653 (FIGS. 17 to 24) an incorporated slope hinge of the base guiding structure of the extension screed is provided in the base screed. The base guiding structure of the extension screed can be pivoted in the slope hinge by means of a turnbuckle supported at the base screed in order to set the angle for a slope to be formed. A scissor lever mechanism elevation adjustment assembly is arranged between the slope hinge and the base guiding structure to vary the elevation of the sole plate of the extension screed in relation to the sole plate of the base screed. The extension guiding structure is telescopically slidable in the base guiding structure. As for variations of the working width, only a limited sort stroke of the extension guiding structure in the base guiding structure can be used, the working width cannot be varied to a measure corresponding with the twofold width of the base screed. In order to avoid that paving material lying on the planum is clamped in-between the extension screeds when the working width is markedly reduced, plough structures are formed at the front side inner ends of the extension screed. The extension screed sole plate is mounted at a sole plate frame structure fixed to the extension guiding structure.

In the front-mount paving screed known from U.S. Pat. No. 4,818,140 having extension screeds at the front side of the base screed the base guiding structure consisting of rails is pivoted by a jack screw at the base screed. In addition, the elevation of the base guiding structure can be adjusted vertically relative to the base screed by two spaced apart screw jacks. The extension screed sole plate is mounted via the sole plate frame structure to the shell-shaped extension guiding structure which in turn can be displaced in the base guiding structure. The extension screed sole plate is divided at a berm pivot region into two parts. In order to form a berm one part can be pivoted upwardly relative to an end gate by an actuator. The actuator is supported at the extension guiding structure. The working width of the paving screed cannot be varied to a measure corresponding to the twofold width of the base screed.

In the paving screed known from US 2002/01062443 A and US 2002/0106242 A1 the extension screed sole plate is subdivided in a berm hinge into a first inner section and a second outer berm section. The entire extension screed sole plate can be tilted by a mechanism relative to the sole plate frame structure about a lateral axis extending parallel to the sliding direction, in order to change the attack angle of the extension screed sole plate individually.

SUMMARY OF THE INVENTION

It is an object of the invention to provide a structurally simple paving screed allowing to change the working width substantially to a measure corresponding to the twofold width of the base screed, and allowing to eliminate the danger that any adjustments of the extension screed relative to the base screed are hindered by weight forces or forces resulting from the working process.

According to the present invention only the slope angle of the extension screed is adjusted within the base screed at the base guiding structure. This allows to stably mount the base guiding structure in the base screed in a structurally simple fashion. The elevation adjustment assemblies and the vertical guidances are loaded much less, as no elevation adjustments will be executed between the base screed and the base guiding structure, or the guiding sub-structure and the extension guiding structure. The guiding sub-structure and the extension guiding structure are structurally rigid and stably take-up all resulting forces even when the extension screed is fully extended. As the elevation adjustment assemblies and the vertical guidances are provided between the extension guiding structure and the sole plate frame structure they be adapted structurally to precisely match with the occurring motion relations and force relations between the extension guiding structure and the sole plate frame structure only. The elevation adjustment assemblies and the vertical guidances are loaded only by weight forces of the sole plate frame structure and the forces resulting from the working process, but remain free from any weight forces of the extension guiding structure, of the guiding sub-structure and of the base guiding structure. For these reasons adjustments of the elevation of the extension screed can be executed more smoothly and rapidly and without hindrance by parasitic forces.

Expediently, the base guiding structure is stably supported in a solid slope hinge fixed in the base screed. The slope hinge has a single hinge axis substantially parallel to the working travelling direction. The at least one actuator anchored to the base screed and provided for adjusting the slope angle of the extension screed, preferably a hydro-cylinder, is acting with an advantageously long lever arm at the base guiding structure with respect to the slope hinge. As the actuator does not need to carry out adjustments of the elevation of the extension screed while being loaded with the total weight of the extension screed, but takes up pivoting forces and supporting forces in the slope hinge with a favourable long lever arm of such forces for any selected slope angle, the extension screed remains stably supported in the base screed. Although the principle according to the invention is very favourable in a front-mount paving screed having at least one extension screed mounted to the front side of the base screed, the same principle could also be used in a rear-mounted paving screed having at least one extension screed mounted to the rear side of the base screed.

Front side and rear side as used here relate to the working travelling direction of the paving screed; inner side and outer side refer to crosswise to the working travelling direction.

In an expedient embodiment the slope hinge is provided closer to the end of the base screed associated to the extension screed than the actuator in order to achieve a favourable long lever arm of the force.

Expediently, the base guiding structure is a plate frame having two parallel guiding tubes and is arranged within the base screed. That concept results in a very stable base guiding structure defining a long supporting length for the guiding sub-structure.

Expediently, the guiding sub-structure comprises a sub-structure frame having two first guiding elements which are slidably guided in the guiding tubes of the base guiding structure, and having two second guiding elements which are parallel to the first guiding elements but are offset in relation to the first guiding elements. The two guiding element pairs in the sub-structure frame result in high rigidity and large guiding support length of the guiding sub-structure despite small dimensions of the guiding sub-structure.

Expediently, the extension guiding structure comprises a frame having two spaced apart vertical plates extending perpendicular to the slide direction, and having two parallel guiding tubes fixed between and to the vertical plates. The two guiding tubes are slidably guided on the two second guiding elements of the sub-structure frame of the guiding sub-structure. The threefold combination of the base guiding structure, of the guiding sub-structure and of the extension guiding structure forms three components which can be telescoped over distinct first and second strokes in relation to each other. The sum of the first and second sliding strokes allow to reach a maximum working width substantially corresponding to the twofold width of the base screed. Even with the extension screed fully extended favourably long guiding support lengths will be maintained between respective two of the three components. The vertical plates of the extension guiding structure, furthermore, fulfil a multiple function as they stiffen the extension screed structure and assist for the vertical guidance and the adjustment of the elevation of the sole plate frame structure.

In an expedient embodiment the respective guiding support length of the guiding sub-structure in the base guiding structure and of the extension screed structure in the guiding sub-structure amount to about one third of the sum of the first and second sliding strokes. This results in a very stable support of the extension screed against forces resulting from the working process even when the extension screed is fully extended.

With a view to high rigidity and minimal mounting space the guiding tubes of the base guiding structure and the first one of the second guiding elements of the guiding sub-structure are situated substantially in a common horizontal plane. At the other side, the guiding tubes of the extension guiding structures and the two second guiding elements of the guiding sub-structure are situated substantially vertically above each other. This results in a favourable and statically determined and spatial rigidity.

Expediently, the elevation adjustment assemblies are fixed at one end either at least one guiding tube of the extension guiding structure or at the extension guiding structure itself, and at the other end at the sole plate frame structure. This results in favourable short elevation adjustment assemblies. The vertical guidances are provided between the sole plate frame structure and the vertical plates of the extension guiding structure and may be favourably long.

Expediently, the vertical guidances comprise long-slot guidances penetrated by several guiding bolts, e.g. in vertical beams of the vertical plates, in order to stably guide and support the sole plate frame structure. These long-slot guidances may be covered, preferably, by covering sheet metal fixed at the guiding bolts, such that lubricant reservoirs are kept in encapsulated and such that paving material is not allowed to intrude there. The vertical guidances, furthermore, keep away any lateral forces from the elevation adjustment assemblies, e.g. forces resulting from the working process, such that the elevation adjustment assemblies operate smoothly without jamming.

Expediently, both elevation adjustment assemblies comprise screw spindles which can be threaded in spindle blocks fixed at least at the extension guiding structure. The screw spindles, furthermore, are rotatably supported in blocks which are fixed to the sole plate frame structure. Both screw spindles may be coupled to a common drive, e.g. a hydromotor or an electric motor having a gear mechanism, which motor may be supported at the sole plate frame structure. Hydro-cylinders could be used instead of screw spindles.

An expedient embodiment of the paving screed, allowing to produce with the extension screeds in addition to a flat road surface either a slope and a berm or only a slope or only a berm, is characterised in that the extension screed sole plate or a lower frame of the sole plate frame structure carrying the sole plate is sub-divided in a berm joint region with a joint axis substantially parallel to the hinge axis of the slope hinge into a first section connected with an inner lower frame section and in a second berm section which can be pivoted about the joint axis in relation to the first section. The lower frame is suspended at an upper frame of the sole plate frame structure. The lower frame is divided into the inner frame section and an outer frame section at which frame sections the first and second sections of the extension screed sole plate are attached. When both sole plate sections are adjusted parallel to the sole plate of the base screed, the extension screed forms a straight prolongation of the road surface. The elevation adjustment assemblies allow to respectively match the height position of the rear lower edge of the extension screed sole plate substantially with the height position of the rear lower edge of the base screed sole plate. Then, the base guiding structure and the sliding direction of the extension screed will be parallel to the base screed sole plate. When both sections are parallel to each other and when the base guiding structure is pivoted in the slope hinge, the extension screed will form a slope at the edge of the road surface. When the base guiding structure is adjusted with the guiding direction parallel to the base screed sole plate, and when the second berm section is pivoted relative to the first section of the extension screed sole plate, the extension screed will form a berm in the edge region of the roadbed. When the extension guiding structure is pivoted in the slope hinge and the second berm section of the extension screed sole plate is pivoted in relation to the first section, the extension screed will form a slope and a berm in the edge region of the roadbed.

For adjusting the berm angle or the berm height at least one actuator is provided on the extension screed sole plate or the frame sections of the lower frame. The actuator interconnects the first section over the berm joint region directly to the second section. The actuator adjusts the relative angle between both sections and maintains this angle, optionally in a fixed berm end position of the second section.

Expediently, the actuator operating between the sole plate sections of the extension screed sole plate or between the frame sections of the lower frame may by a hydro-cylinder or a screw jack. In case that the actuator is co-operating with an elbow lever mechanism defining mechanically limited end positions for both the maximum berm angle or berm height and for the parallel alignment of both sole plate sections, the actuator is only needed execute the adjustment but thereafter is hardly loaded as the elbow lever mechanism takes up and transfers forces between the sole plate berm section and the upper frame.

In a further expedient embodiment the attack angle of the extension screed sole plate in working travelling direction and relative to the planum can be individually adjusted within the sole plate frame structure. The lower frame of the sole plate frame structure may be tilted there in relation to the upper frame about a horizontal hinge axis substantially parallel to the sliding direction. The hinge axis may be constituted by an incorporated hinge, or, preferably, is constituted only by the elasticity of the extension screed sole plate which in this region can be bent in relation to a fixing region at the sole plate frame structure. An attack angle adjustment device is supported at the upper frame and engages at least at the first inner section of the extension screed sole plate or at the inner frame section of the lower frame of the sole plate frame structure. When the attack angle of the first inner section of the sole plate is changed, by means of the berm hinge region also the attack angle of the second section is changed accordingly.

A structurally simple embodiment of the attack angle adjustment comprises a screw spindle which is placed in the extension screed for access from the exterior and from above. The screw spindle is threadable in a nut body at the sole plate frame structure and is coupled with a gear mechanism provided in the upper frame of the sole plate frame structure. The gear mechanism is coupled at several locations at least with the first inner section of the extension screed sole plate or the inner frame section of the lower frame of the sole plate frame structure. By rotating the screw spindle in the nut body the front edge of the extension screed sole plate is pivoted in relation to the hinge axis situated in working travelling direction at the rear of the sole plate. Alternatively, the extension screed sole plate is only bent in the hinge axis using the elasticity of the material.

In an expedient embodiment in the berm hinge region between the first and second sections a convexly rounded end edge of one section of the extension screed sole plate engages into a concavely rounded end edge of the other section. The end edges fitted into each other avoid that a gap may be opened when pivoting the second section in relation to the first inner section, which gap could cause an irregularity in the road surface of the roadbed. In order to additionally stabilise the berm hinge region, inter-engaging circular guiding parts may be arranged on both sole plate sections or both frame sections of the lower frame. The guiding parts define a stable hinge axis in the berm hinge region in co-action with the form-fit engagement between the rounded end edges.

In order to avoid that paving material flows outwardly beyond the respective working width, an end gate is mounted at the outer end of the extension screed and at the upper frame of the sole plate frame structure. The end gate protrudes in working travelling direction forwardly beyond the extension screed. The outer end of the second berm section of the extension screed sole plate moves in relation to the end gate such that when forming a berm the end gate will form the outer boundary of the roadbed.

In a further important embodiment a plough structure is arranged at the inner end of the first section of the extension screed sole plate of the front-mount paving screed. The plough structure e.g. is also secured to the respective frame section of the lower frame of the sole plate frame structure. The plough structure peels off and displaces paving material lying on the planum when both extension screeds move towards each other. The plough structure is defined by an edge section of the first section of the extension screed sole plate which edge section extends substantially parallel to the working travelling direction, by a first inclined repelling surface extending upwardly and outwardly from the edge section and by at least one further substantially vertical repelling surface. This repelling surface combination of the plough structure does not significantly shovel off paving material as long as the working width is kept steady, such that this paving material in-between the extension screeds is embedded into the roadbed by the base screed. However, while reducing the working width some of the paving material laying on the planum respectively in front of the plough structure is peeled off and is displaced inwardly and forwardly by the plough structure before it is brought into the roadbed by the base screed, preventing that paving material will finally remain clamped between the extension screeds and hinders that the extension screeds may be retracted maximally towards each other.

A front wall may be mounted at the sole plate frame structure in working travelling direction in the front. The front wall may extend from an upper region downwardly in front of a draw-in nose of the extension screed sole plate. The front wall, which expediently is prolonged by another extension screed front wall extending upwardly to the elevation of the extension guiding structure, operates as a scraper plate limiting the thickness of a paving material layer for the extension screed sole plate draw-in nose, and taking up dragging forces of a potentially much higher paving material heap present in front of the extension screed.

As the extension guiding structure does not extend over the entire inner width of the extension screed but only is occupying an inner part of the width, weight is saved and a long second stroke is achieved for the extension guiding structure on the guiding sub-structure. The guiding sub-structure may be substantially as broad as the extension screed itself. The second sliding stroke then results from the width difference between the extension guiding structure and the guiding sub-structure.

In an expedient embodiment the first horizontal actuator is arranged at the base screed and is linked to the plate frame of the base guiding structure and to the frame of the guiding sub-structure. At the other side, the second horizontal actuator is arranged in the extension guiding structure and is connected at one end to one vertical plate of the extension guiding structure and at the other end to a frame of the guiding sub-structure.

In a further embodiment the base screed is equipped with two tow bar connection beams. Each connection beam can be pivoted about a horizontal axis substantially perpendicular to the working travelling direction in the base screed. An attack angle adjustment device for adjusting the attack angle of the sole plate of the base screed may be provided between the base screed and each connection beam in this case. Hence, the attack angle of the sole plate of the base screed cannot only be adjusted by varying the inclination of the tow bars, but in addition or alternatively by relative adjustments between the connection beams and the base screed.

Expediently, furthermore, the base screed is sub-divided into two base screed parts which are pivotably interconnected in a hinge having a hinge axis which is substantially parallel to the working travelling direction. A crown profile adjustment device may be provided between both base screed parts. In this fashion with the same base screed either a flat road surface of a roadbed may be formed, or a roadbed having a road surface with a crown profile. In this case, e.g., the sole plate of the base screed may be continuous without any interruption, meaning that the sole plate of the base screed is bent using the material elasticity locally when adjusting a crown profile. Alternatively, the sole plate of the base screed could be divided into two parts which can be adjusted in relation to each other by a relative movement between two base screed parts in then hinge axis.

BRIEF DESCRIPTION OF THE DRAWINGS

Embodiments of the invention will be explained with the help of the drawings. In the drawings is.

DETAILED DESCRIPTION OF THE INVENTION

Figure 1:
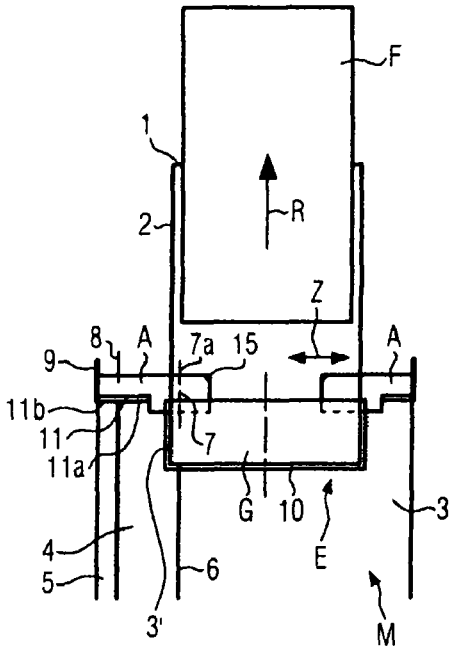
FIG. 1 a schematic top view of a road paver towing a paving screed in working travelling direction and while producing a roadbed, FIG. 2 a schematic rear view of the road paver of FIG. 1, FIG. 3 a perspective view in viewing direction from the front outer side counter to the working travelling direction in FIGS. 1 and 2, of one half of an embodiment of a paving screed adjusted to maximum working width, FIG. 4 a perspective view of an enlarged detail of FIG. 3, in viewing direction on the paving screed from the outer upper side, FIG. 5 a front view counter to the working travelling direction of the half of the paving screed of FIG. 3, with covering structural components removed for a better understanding, FIG. 6 a rear view of the paving screed forming a slope in viewing direction in working travelling direction with one extension screed partially extended, FIG. 7 a perspective view in viewing direction counter to the working travelling direction from the outer upper side, with structural components of the paving screed removed for a better understanding, FIG. 8 a rear view of a detail of the extension screed forming a berm in viewing direction in working travelling direction, FIG. 9 a schematic illustration of a detail alternative, FIG. 10 a schematic illustration of a detail of a berm hinge region, as a completion to FIG. 8, FIG. 11 a front view counter to the working travelling direction of a detail, with structural components removed, FIG. 12 a perspective view of a detail of the paving screed at a small working width in viewing direction counter to the working travelling direction and from above, and FIG. 13 a perspective view of upper and lower frames of a sole plate frame structure.
Figure 2:
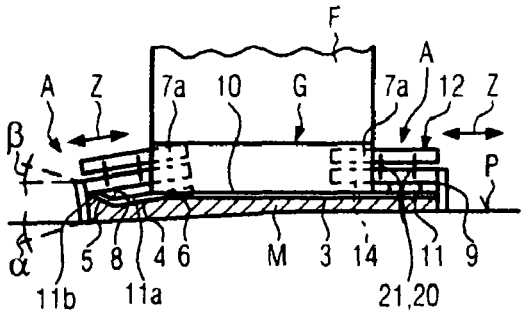

FIGS. 1 and 2 illustrate in schematic top view and schematic rear views a road paver F when constructing a roadbed M on a planum P. The road paver F is towing (working travelling direction R) a paving screed E with tow bars 2, linked to towing points 1 at the road paver F and are fixedly mounted to connection beams 3' of the paving screed E. The towing points 1 may be adjusted e.g. vertically, at both sides of the road paver for the same amounts or for different amounts. The height positions of the towing points 1 influence the layer thickness of the roadbed M. The paving screed E consists of a base screed G and, in the shown case, of at least one of two extension screeds A which can be extended and retracted in a linear sliding direction Z at the base screed G. In the shown embodiment, preferably, the extension screeds A are mounted at the front side of the base screed G (front-mount paving screed E) At least one sole plate 10, 11 is mounted at a bottom side of the base screed G and of each extension screed A. The sole plates 10, 11 level the surface of and compact the roadbed M. The extension screeds A, alternatively, may be mounted to the rear side of the base screed G (rear-mounted paving screed).

Different roadbeds M and road surface profiles can be produced with the paving screed E. In one case the roadbed M has a continuously flat road surface 3 extending over the full working width of the paving screed. Optionally, the base screed G may be divided adjustably in the middle in order to form a road surface 3 having a crown profile. If, as shown in FIGS. 1 and 2, the left side extension screed A in working travelling direction R is pivoted in a slope hinge 7 of the base screed G about a hinge axis 7*a* to define a slope angle $\alpha$ with the base screed G, a flat slope 4 is formed in the roadbed M beginning at a transition 6 at the side edge region the roadbed M. The slope 4 slopes downwards at the angle α. In another case a berm 5 continuing the slope 4 may be formed, i.e., a counter slope ascending outwardly with an angle β. The berm 5 could be formed at the edge region of a flat road surface 3 or of a road surface having a crown profile without simultaneously forming a slope 4. The slope 4 and/or the berm 5 is or are formed by the sole plate 11 of the extension screed A.

In order to allow to form the berm 5 the extension screed sole plate 11 is divided at a berm hinge region 8 with an hinge axis which is substantially parallel to the hinge axis 7*a* of the slope hinge 7 into an inner first section 11*a* and a second outer, pivotable berm section 11*b*. An end gate 9 is mounted at the outer end of each extension screed A. The end gate 9 extends in working travelling direction R forward beyond the sole plate 11 of the extension screed A and prevents that paving material flows outwardly beyond the working width. When constructing a roadbed M with the flat or profiled road surface 3 and at least one slope 4, the width of the flat road surface 3 should remain unchanged when the working width is varied by retracting or extending the extension screeds A in sliding direction Z. For producing roadbed junction regions of real estate drives and/or of crossroads the working width e.g. is increased preliminarily while forming the junction with smooth transitions.

The pivot support of each extension screed A in the base screed G comprises in the incorporated slope hinge 7 with the hinge axis 7*a* which is substantially parallel to the working travelling direction R. The slope hinge 7 (provided for adjusting the slope angle α of the extension screed sole plate 11) is situated at or close to the end of the base screed G which is associated to the respective extension screed A. The width of each extension screed A or the extension screed sole plate 11 measured crosswise to the working travelling direction R corresponds substantially with the half width of the base screed G such that the maximum working width with fully extended extension screeds A substantially corresponds to the twofold width of the base screed G.

Part of the paving screed E is a telescopeable guiding system 12 only schematically indicated in FIG. 2. A sole plate frame structure 14 for the sole plate 11 of the extension screed A is arranged at the guiding system 12 such that the sole plate frame structure 14 can be adjusted by elevation adjustment assemblies 21 and vertical guidances 20 in its relative elevation substantially vertical in relation to the sliding direction Z. The sole plate frame structure 14 e.g. consists (FIG. 13) of an upper frame 14A and a lower frame 14B. Each end gate 9 (FIG. 8) is attached to the upper frame 14A of the sole plate frame structure 14 such that, as shown in FIG. 2 on the left side, the second berm section 11*b* of the extension screed sole plate 11 can be pivoted relative to the end gate 9 which forms the outer boundary of the produced roadbed M. A detailed embodiment of the paving screed E shown in FIGS. 1 and 2 only schematically will be explained in detail referring to FIGS. 3 to 13. Mainly, it will be referred to the perspective view of the right side part of the paving screed E (in working travelling direction R) in FIG. 3, to the perspective illustration of an essential region of FIG. 3, shown in FIG. 4, the front view in viewing direction counter to the working travelling direction R in FIG. 5, and the rear view in viewing direction in working travelling direction R in FIG. 6.

The telescopeable guiding system 12 in FIGS. 3 and 4 consists of a base guiding structure 18 which is pivotably supported in the slope hinge 7 in the base screed G below and at the inner side of the tow bar connection beam 3' of a guiding sub-structure 17 slidably guided in the base guiding structure 18, and of an extension guiding structure 16 slidably guided in the guiding sub-structure 17. The sole plate frame structure 14 is adjustably attached to the extension guiding structure 16.

Figure 3:
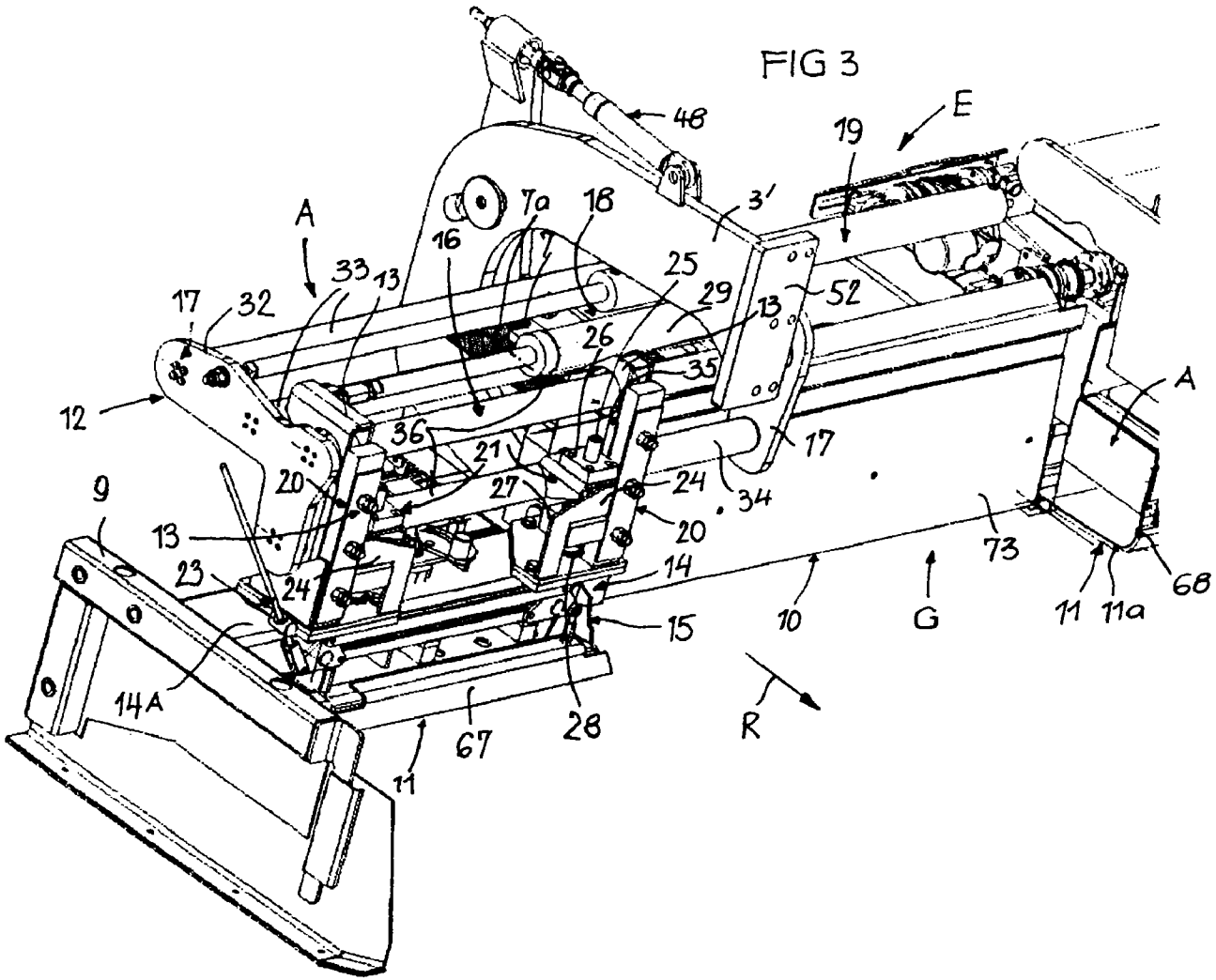
Figure 4:
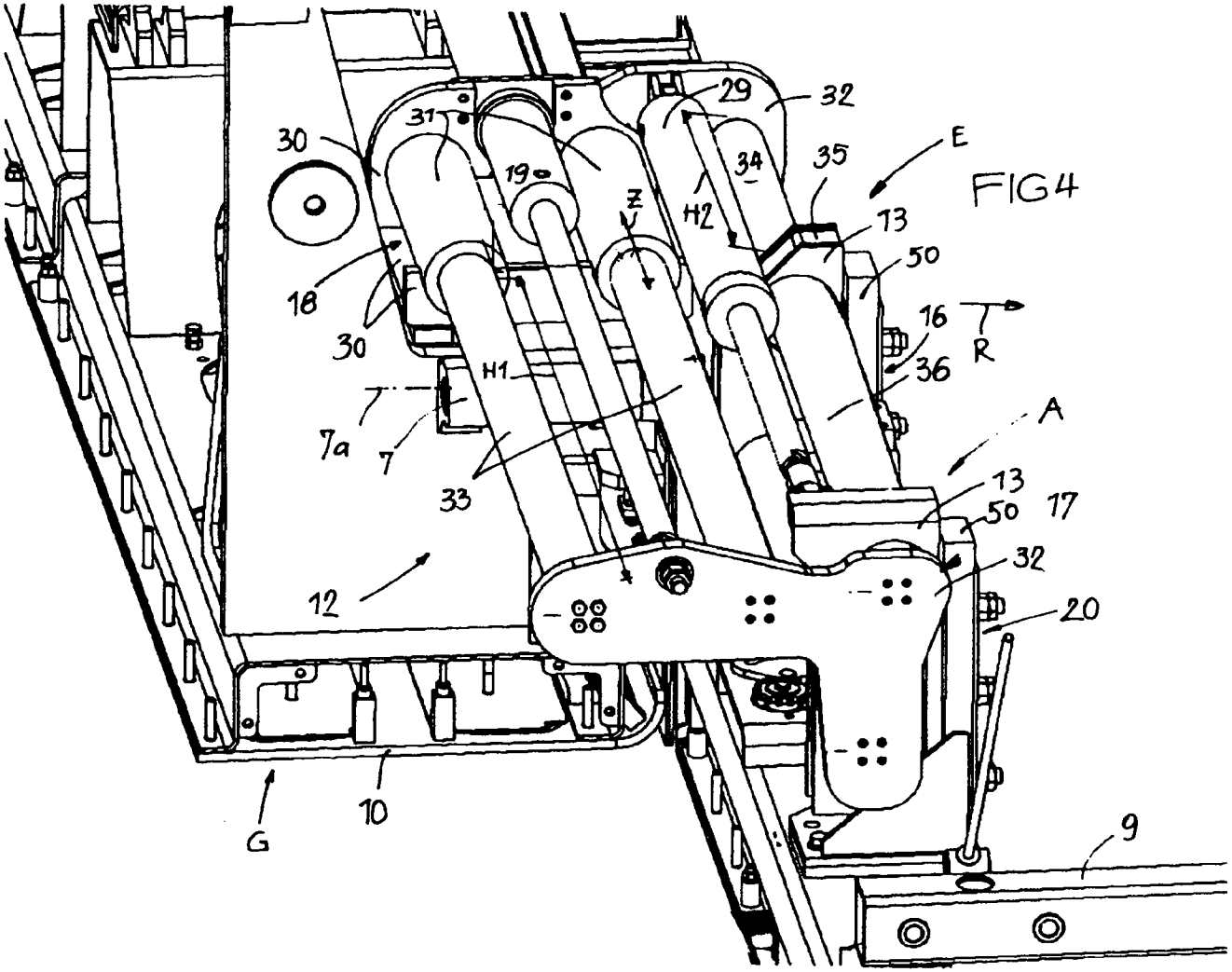
Figure 6:
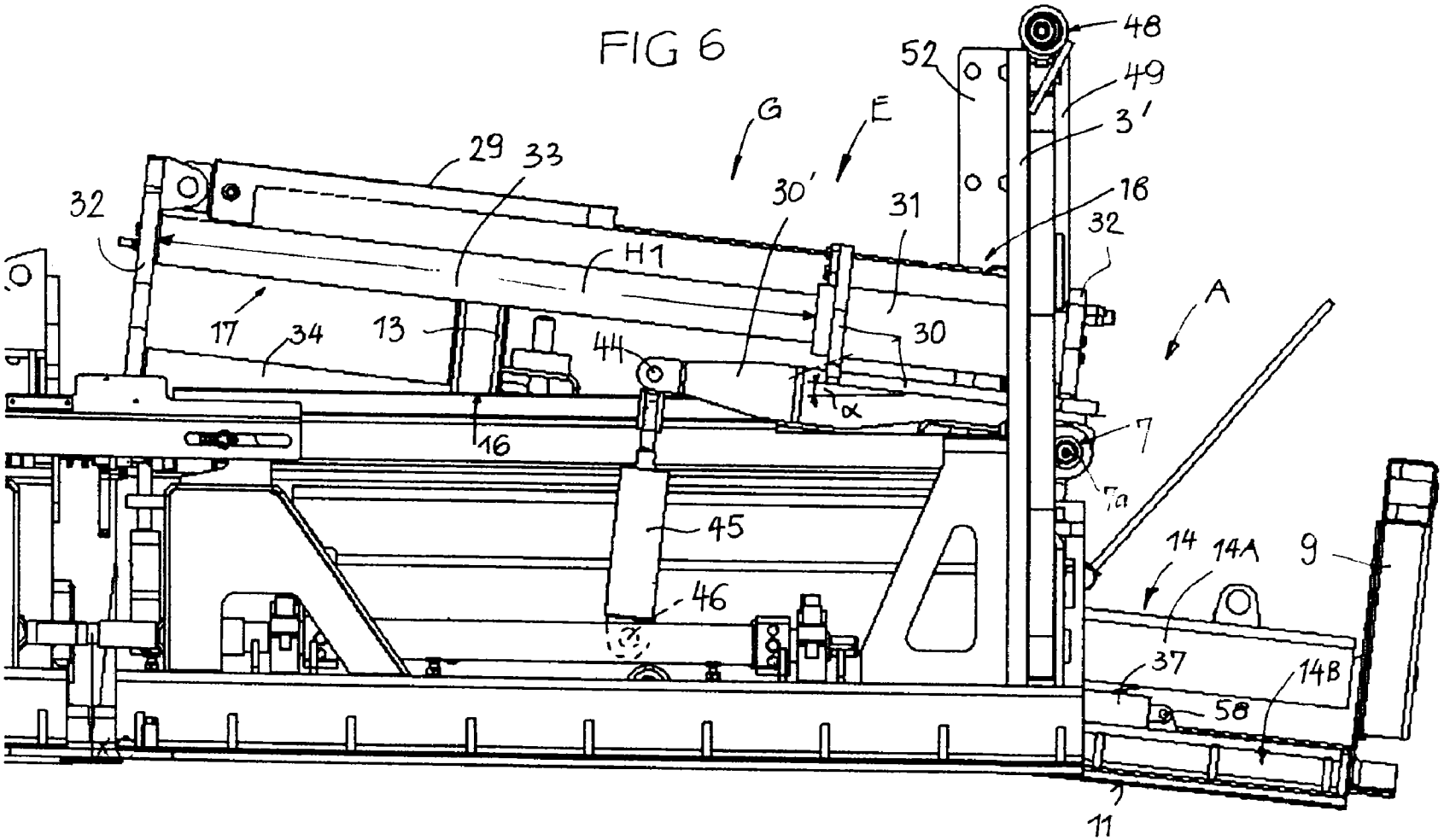

The base guiding structure 18 consists in FIGS. 3, 4 and 6 of two spaced apart parallel guiding tubes 30 which are incorporated into a rigid plate frame having two spaced apart plates 30. Parts of the slope hinge 7 may be arranged at one substantially vertical plate 30 placed essentially below the connection beam 3'. These parts of the slope hinge 7 are connected via at least one pin (not shown in detail) with corresponding slope hinge parts provided in the base screed G.

The base guiding structure 18 (corresponding to the one shown in FIG. 2 on the right side), is adjusted in FIGS. 3 and 4 in the slope hinge 7 such that linear sliding direction Z is parallel to the sole plate 10 of the base screed G, i.e., the slope angle α=0°. To the contrary, in FIG. 6 the base guiding structure 18 is pivoted to form a slope angle α of e.g. maximum 10° or 10% about the hinge axis 7*a* of the slope hinge 7, in particular, by at least one actuator 45 (e.g. a hydraulic cylinder or a screw spindle device or another suitable actuator) arranged between a linking point 44 at an arm 30' attached to the base guiding structure 18 and a linking point 46 in the base screed G. Optionally, either the actuator 45 or the arm 30' then may abut at a not shown stop in the base screed G, in order to stably fix the pivot position of the extension screed A.

Figure 5:
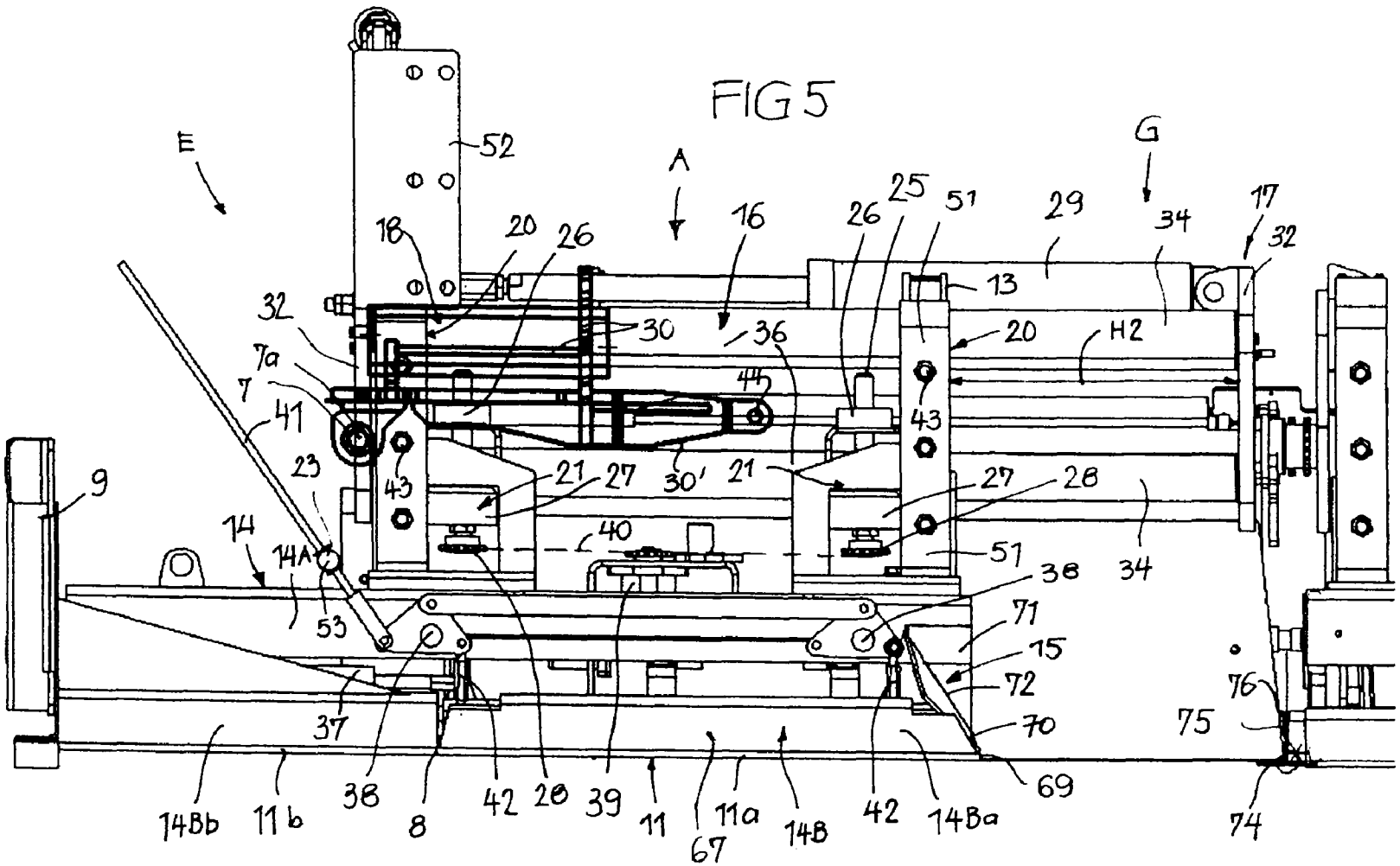

Both guiding tubes 31 of the base guiding structure 18 are penetrated by two parallel guiding elements 33 of the guiding sub-structure 17. These guiding elements 33 may be rods or tubes fixed to two L-shaped end plates 32. The guiding sub-structure 17 can be extended or retracted relative to the base guiding structure 18 through a first stroke H1 (FIG. 4) by a first horizontal actuator 19. The first horizontal actuator 19 e.g. is linked to one of the plates 30 of the base guiding structure 18 and to one of the end plates 32. The first stroke H1 may be longer than the guiding support length of the base guiding structure 18. About in the same horizontal plane as the two first guiding elements 33 an upper one of two second rod-shaped or tube-shaped guiding elements 34 of the guiding sub-structure 17 is fixed between the end plates 32. The upper second element 34 extends parallel to the base guiding structure 18 and is located with lateral distance from one of the first guiding elements 33. The lower of the two second guiding elements 34 is located substantially vertically and with a distance below the upper second guiding element 34 (FIG. 5).

The extension guiding structure 16 is slidably guided on the two second guiding elements 34 of the guiding sub-structure 17 such that the extension guiding structure 16 can travel over a second stroke H2 (FIG. 4). All sliding strokes H1, H2 of the components occur along the common linear sliding direction Z of the telescopeable guiding system 12. The orientation of the sliding direction Z depends on the pivot position of the base guiding structure 18 about the hinge axis 7*a*. The second stroke H2 e.g. is shorter than the first stroke H1, such that finally the extension guiding structure 16 can be moved relative to the base guiding structure 18 for the sum of the strokes H1 and H2. The second stroke H2 could be as long as the first stroke H1 or even could be longer than the first stroke H1.

The extension guiding structure 16 consists of two guiding tubes 36 slidably guided on the second guiding elements 34. The ends of the guiding tubes 36 are interconnected between the end plates 32 of the guiding sub-structure 17 by solid vertical plates 13, extending vertically in relation to the sliding direction Z, and which may support vertical beams 35. The guiding support length of the guiding sub-structure 17 in the base guiding structure 18 corresponds substantially to half of the guiding support length of the extension guiding structure 16 in the guiding sub-structure 17. The extension guiding structure 16 is shorter in the sliding direction Z than the width of the extension screed A. However, the sole plate frame structure 14 may extend to the outside end of the extension screed A.

Figure 7:
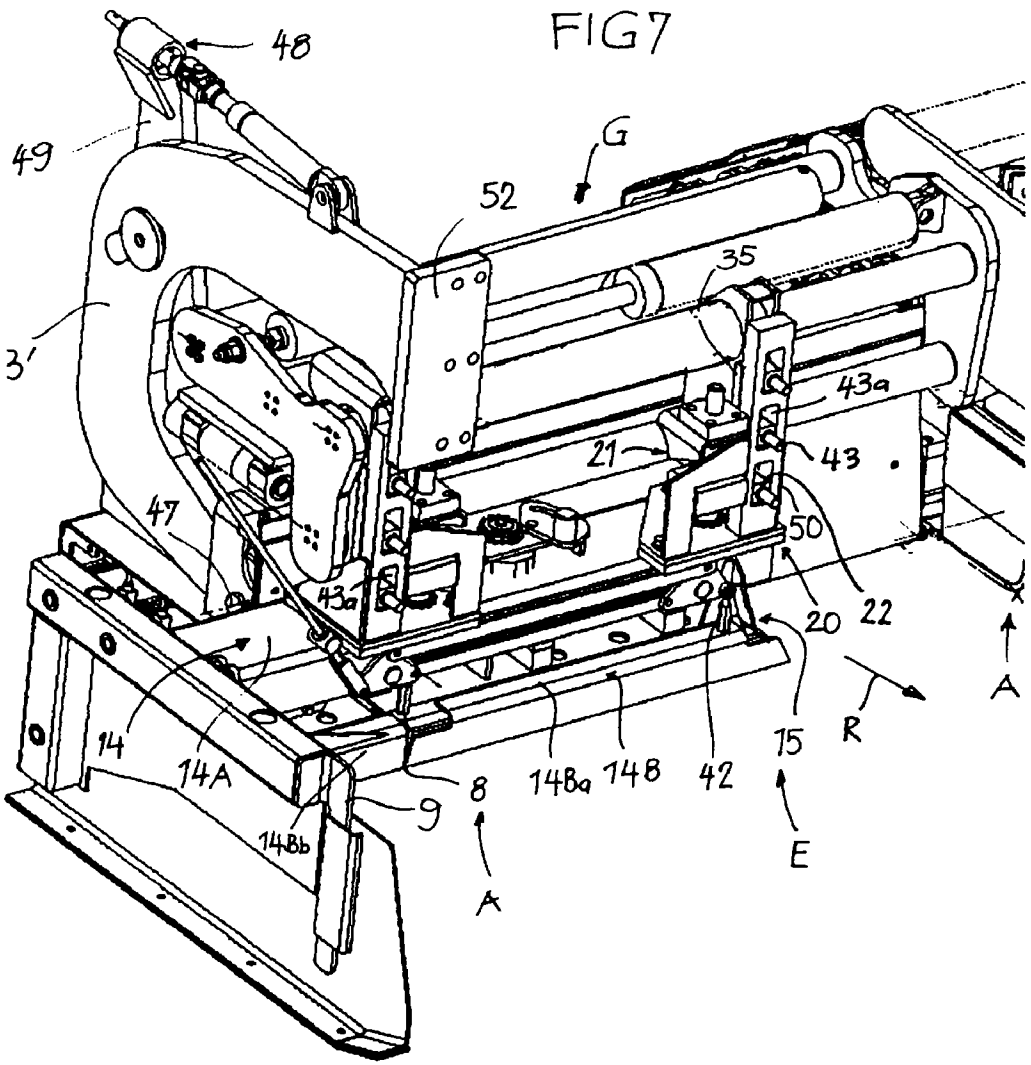

Both elevation adjustment assemblies 21 are structurally associated to the vertical plates 13 or the vertical beams 35, if the latter are provided, and consist of a respective spindle block 26 attached to the extension guiding structure 16 and a block 27, which is either connected to the upper frame 14A or to struts 21 interconnecting the upper frame 14A and a vertical guiding body 50 (FIG. 7). A vertical screw spindle 25 can be threaded in the spindle block 26. The screw spindle 25 is rotatably held in the block 27. The screw spindle 25 is relatively short and carries at a lower end e.g. a chain sprocket 28 which is coupled by means of a chain drive 40 with a drive 39. The drive 39 e.g. is arranged in the upper frame 14A and is provided commonly for both elevation adjustment assemblies 21. The drive 39 may be a hydro-motor or an electric motor having a gear mechanism. Alternatively, both elevation adjustment assemblies 21 could be constituted by hydraulic cylinders, or by other suitable actuators.

The vertical guiding bodies 50 are e.g. arranged at front sides of the vertical beams 35 or at the vertical plates 13 of the extension guiding structure 16. The guiding bodies 50 are linearly guided by a plurality of spaced apart guiding bolts 43 e.g. fixed to the vertical beams 35 and e.g. engaging with sliding blocks 22 (FIG. 7) in long slots 43*a* of the guiding bodies 50. The long slots 43*a* may be covered by covering sheet metal parts 51 (FIG. 5) secured by nuts threaded on the guiding bolts 43.

Figure 12:
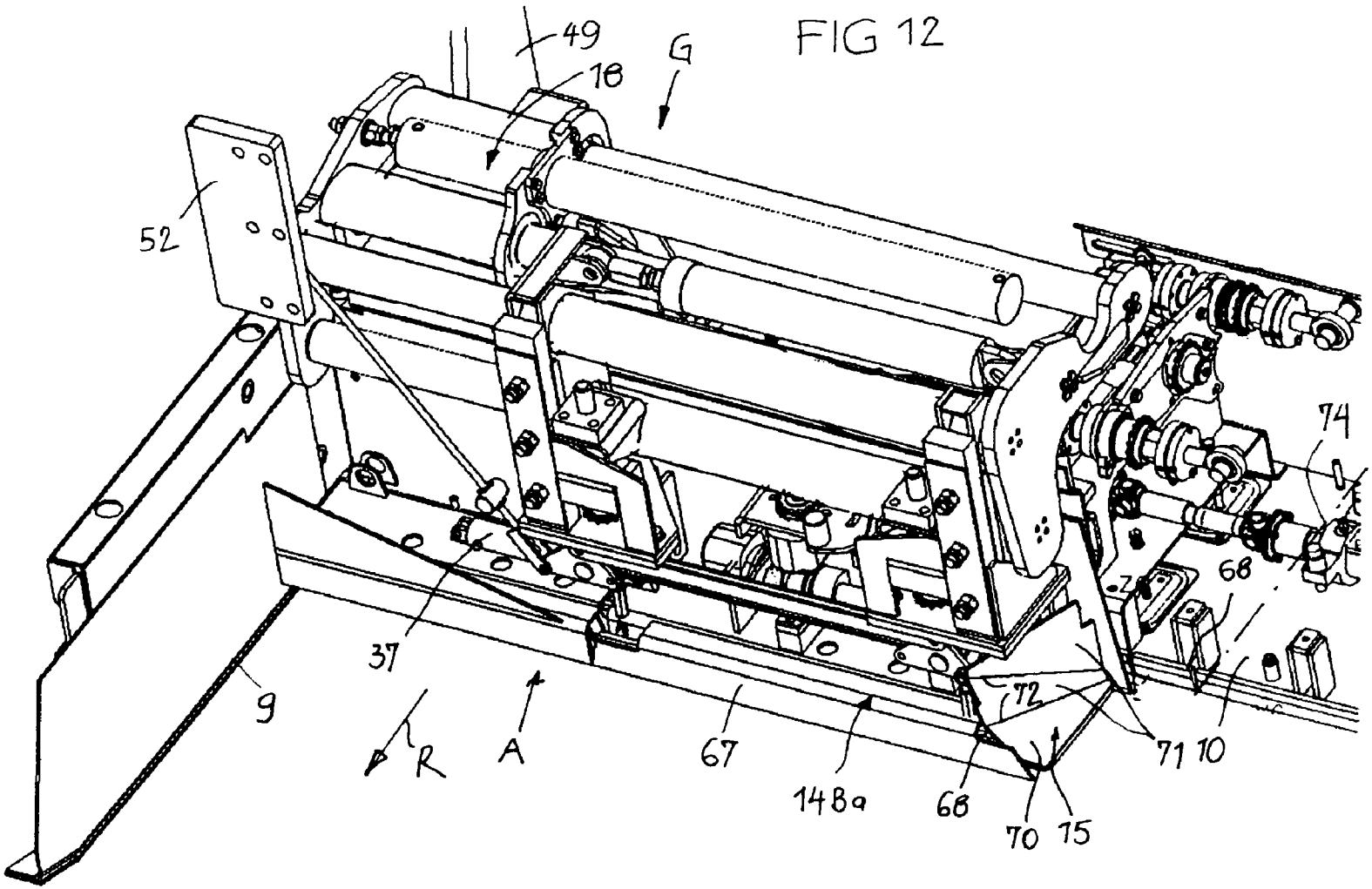
Figure 13:
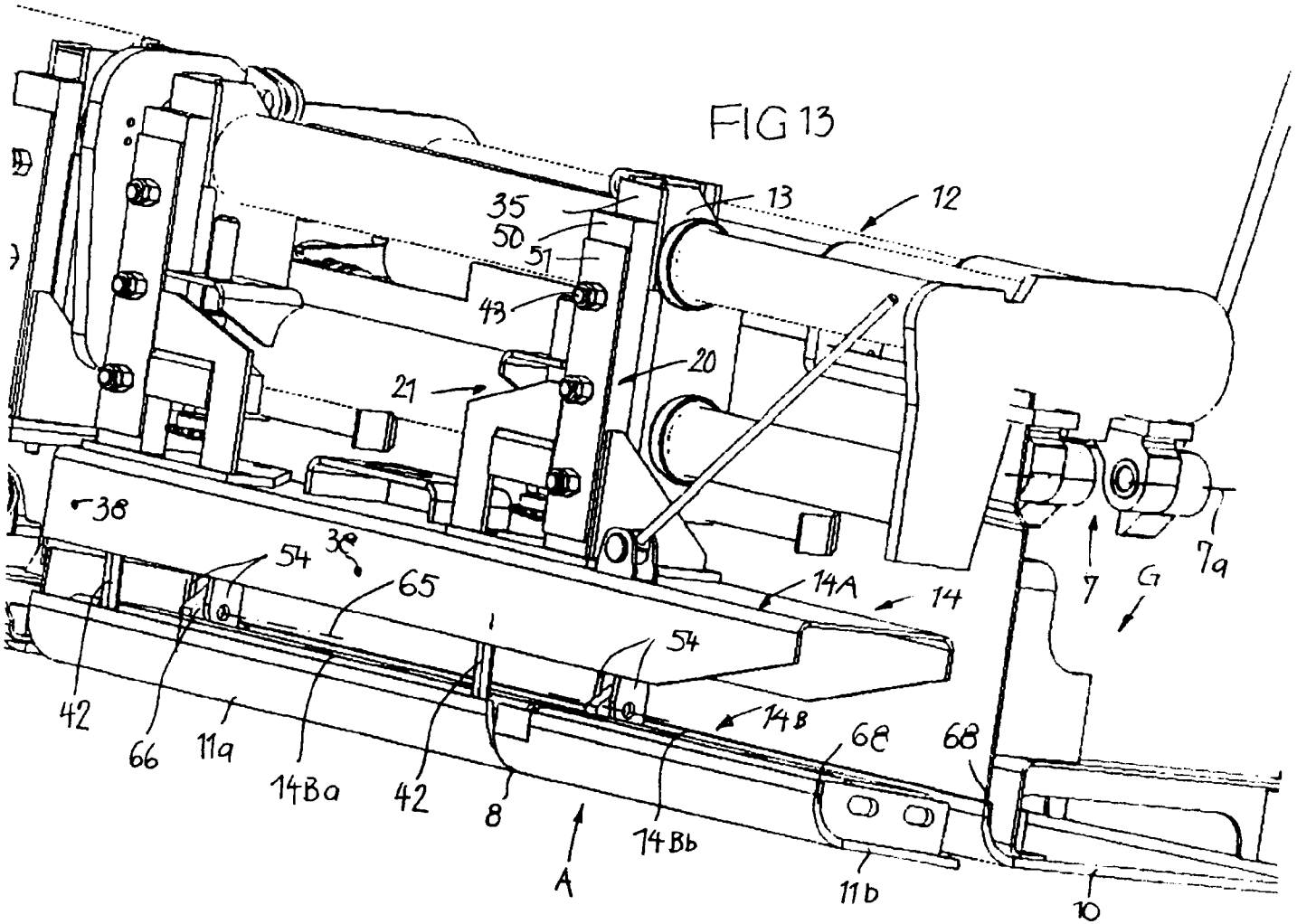
Figure 14:
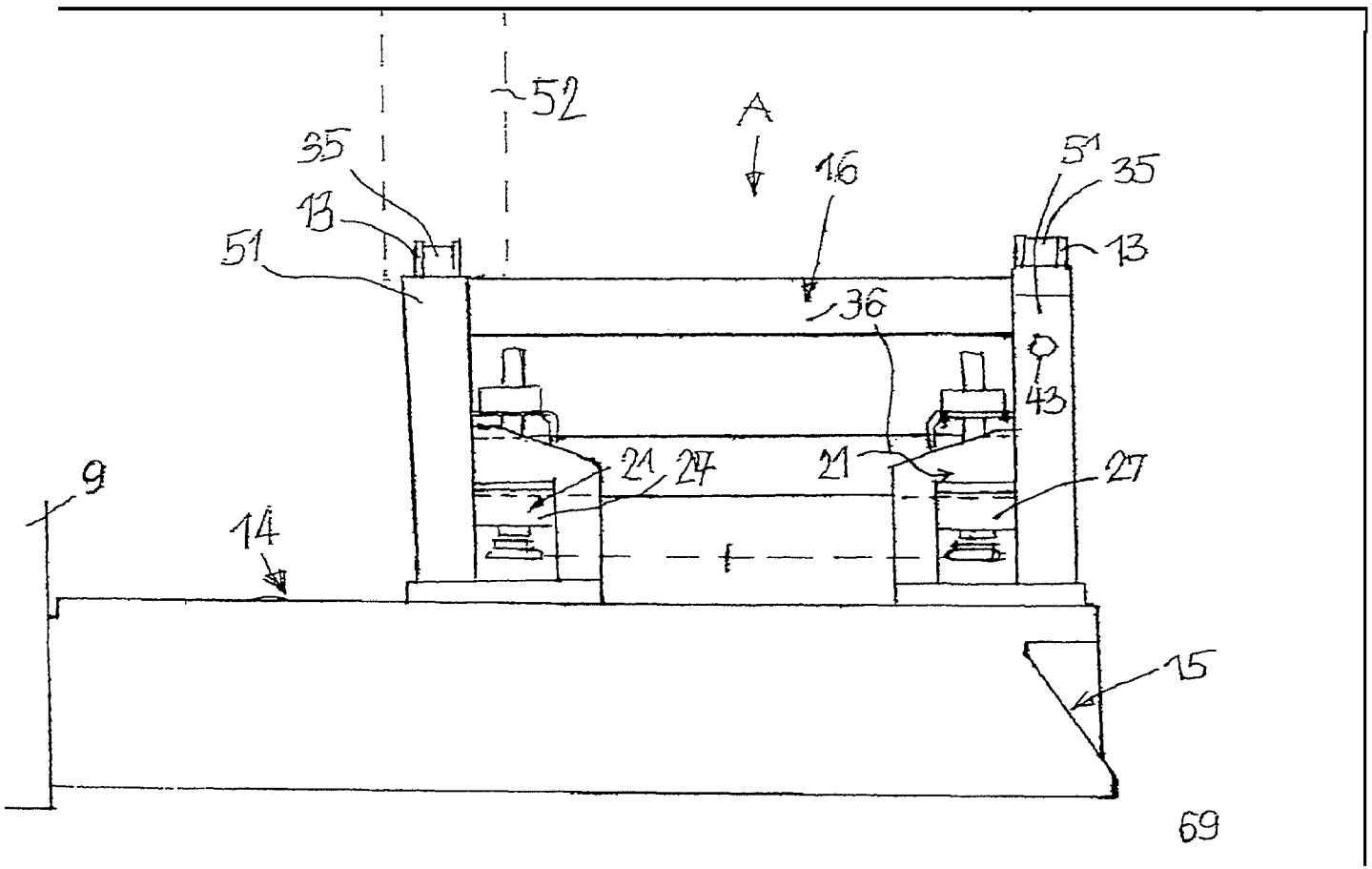
FIG. 14 rear view of the half of the paving screed of FIG. 3.
Figure 15:
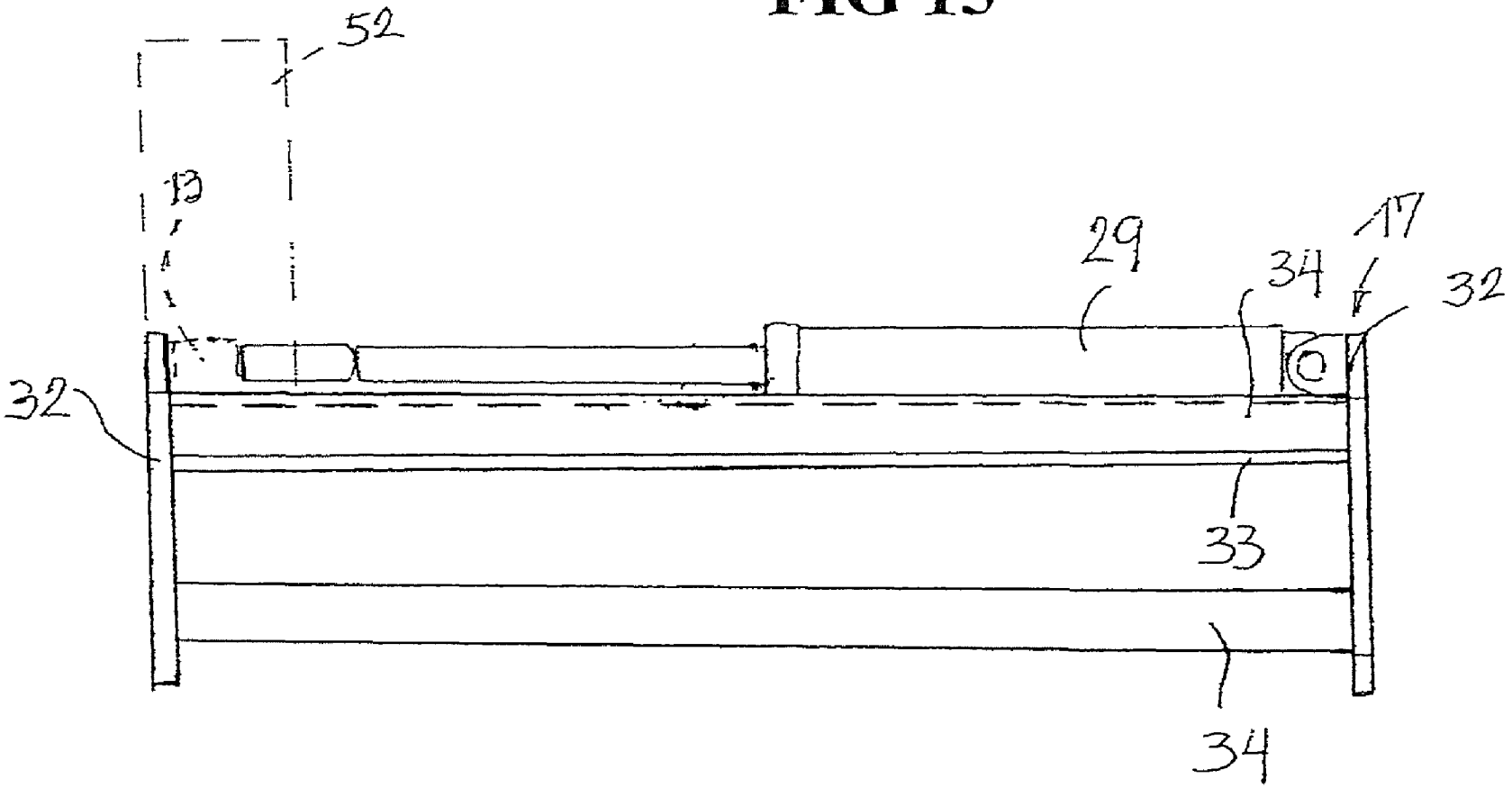
FIG. 15 rear view of guiding substructure and guiding elements.
Figure 16:
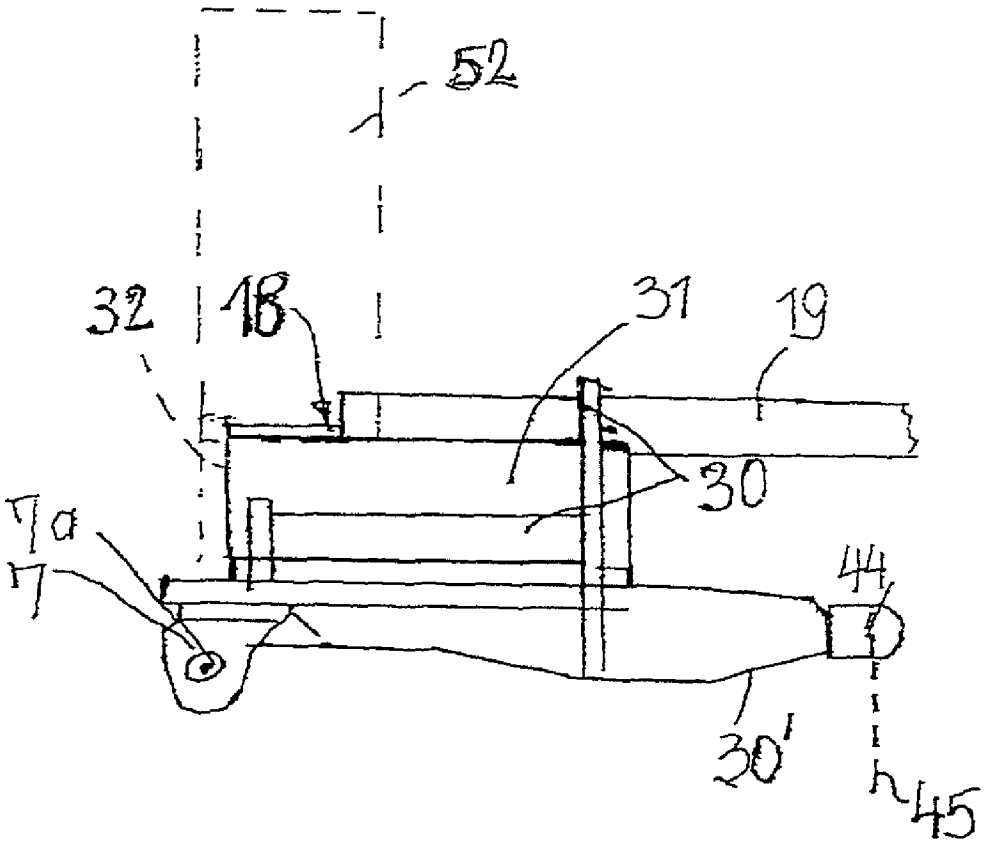
FIG. 16 side view of base guiding structure.
Figure 17:
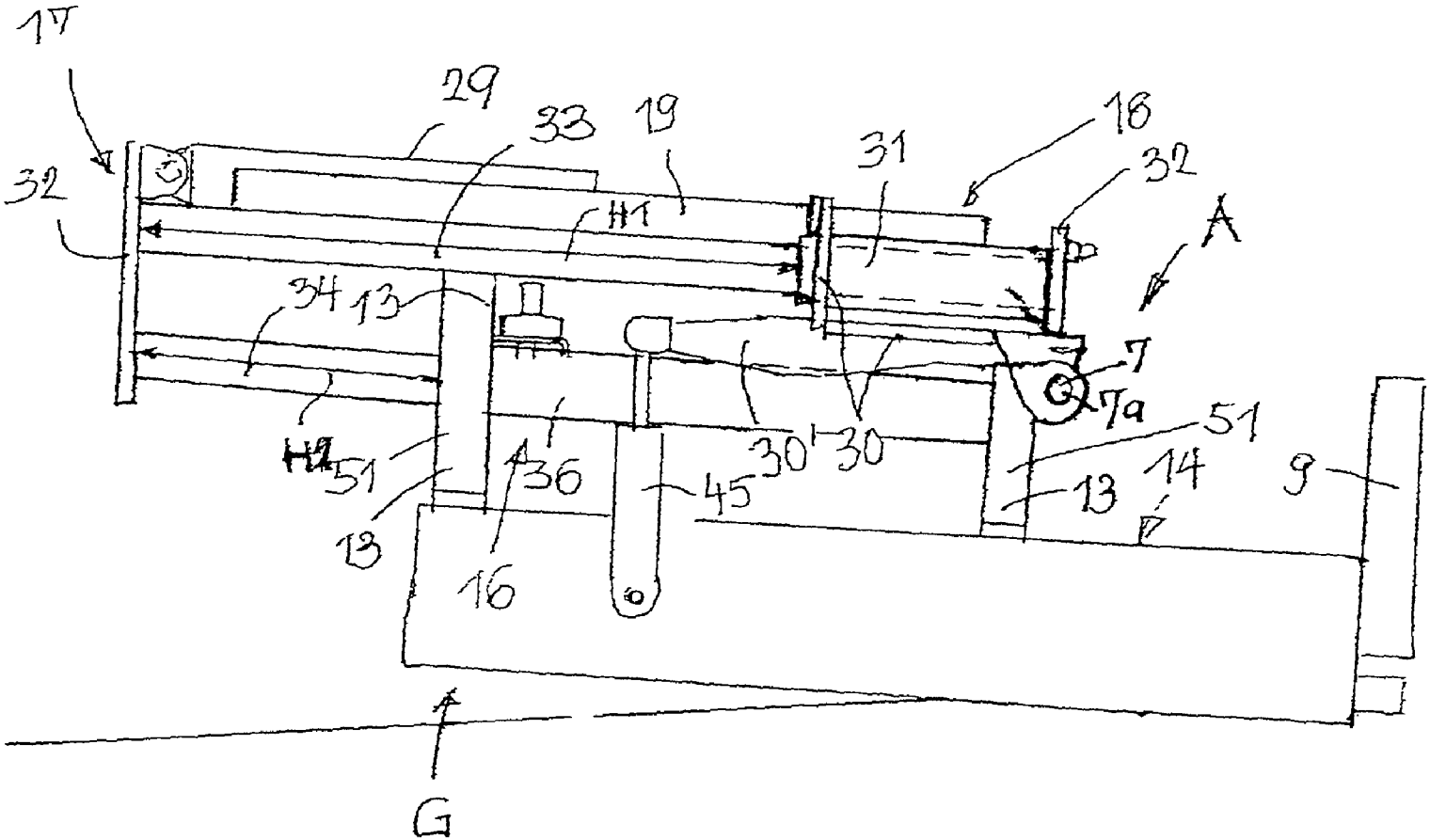
FIG. 17 rear view of slope setting by actuator at base guiding structure.

Incidentally, a front housing cover of the extension screed A (not shown in FIG. 5) may be provided which extends e.g. downwardly over the upper frame 14A into the region of a front wall 67, which extends downwardly in front of a front-side draw-in nose 68 of the extension screed sole plate 11 (FIG. 12). The extension screed sole plate 11 is attached to the lower frame 14B and is directly or indirectly connected at the front edge region (behind the draw-in nose 68)) e.g. by several connection elements 42, and in a rear region (FIGS. 8 and 13) by hingedly connected connection elements 54 and 66 (hinge axis 65, FIG. 13) with the upper frame 14A, respectively. Shown are two connection elements 42 between the upper frame 14A and an inner frame section 14Ba of the divided lower frame 14B (FIG. 13). The connection elements 42 may be turn-buckles allowing to pre-set the distance between the sole plate 11 and the upper frame 14A.

Figure 8:
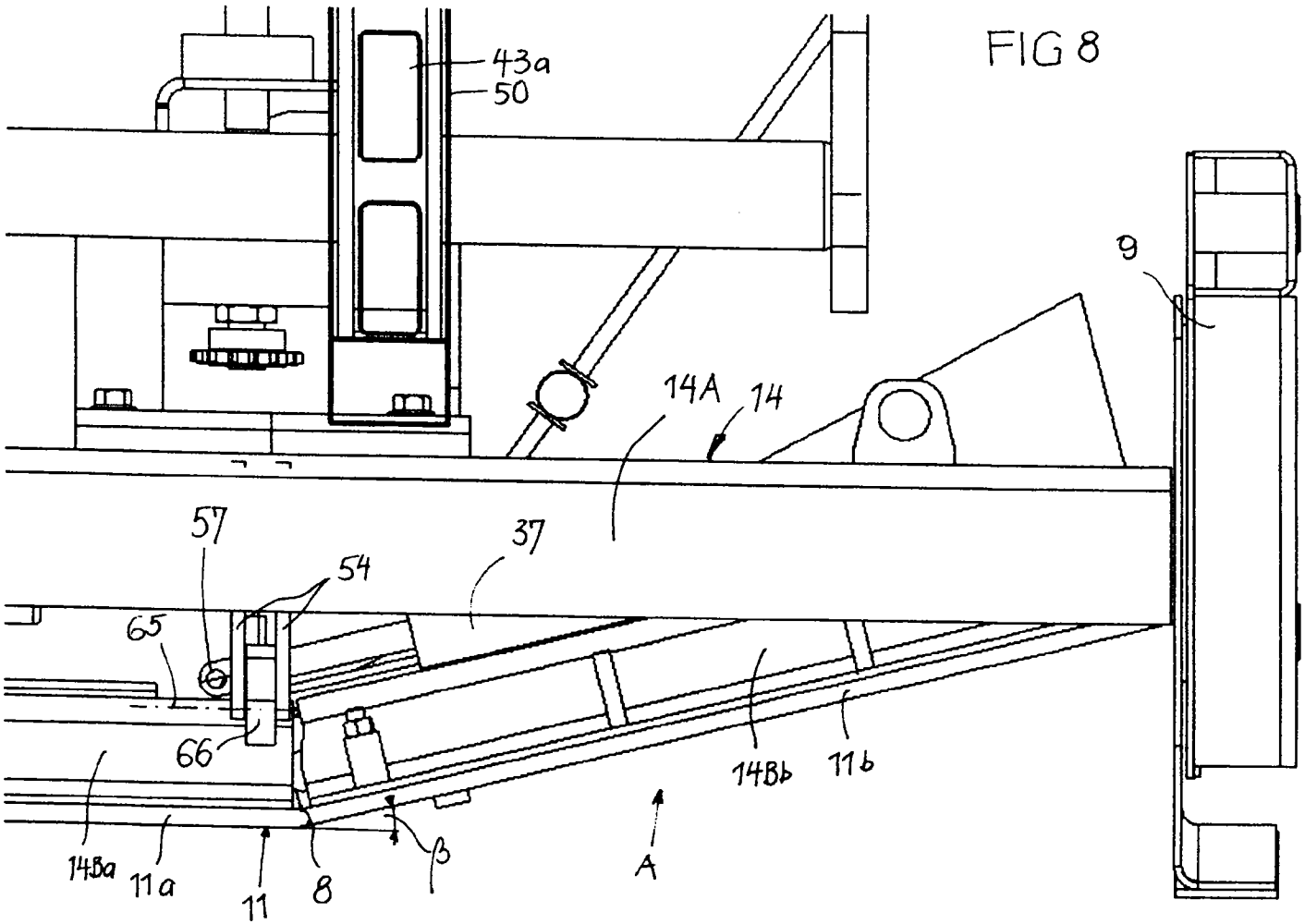

In FIGS. 8 and 13 the extension screed sole plate 11, at least the first inner section 11*a*, is tiltable relative to the upper frame 14A about a hinge axis 65, which extends crosswise to the working travelling direction R and substantially parallel to the planum P. The extension screed sole plate 11 can be tilted in order to allow to adjust another sole plate attack angle relative to the planum P at the extension screed A than the sole plate attack angle of the sole plate 10 of the base screed G. The hinge axis 65 indicated in FIGS. 8 and 13 may (as shown) be an incorporated hinge axis between the connection elements 54, 66 secured to the upper frame 14A and the frame section 14Ba, or is defined (not shown) only by the elasticity of the fixedly secured extension screed sole plate 11, i.e. of the first inner section 11*a*.

An attack angle adjustment device 23 serving to tilt the extension screed sole plate 11 about the hinge axis 65 is provided in the sole plate frame structure 14. A screw spindle 41 extending obliquely upwardly can be rotated in a nut body 53 secured at the upper frame 14A. The rotation of the screw spindle 41 is converted into a linear movement driving a gear mechanism supported at bearing locations 38 (FIG. 5) in the interior of the upper frame 14A. The gear mechanism can be seen in detail in FIGS. 11 and 13.

Figure 11:
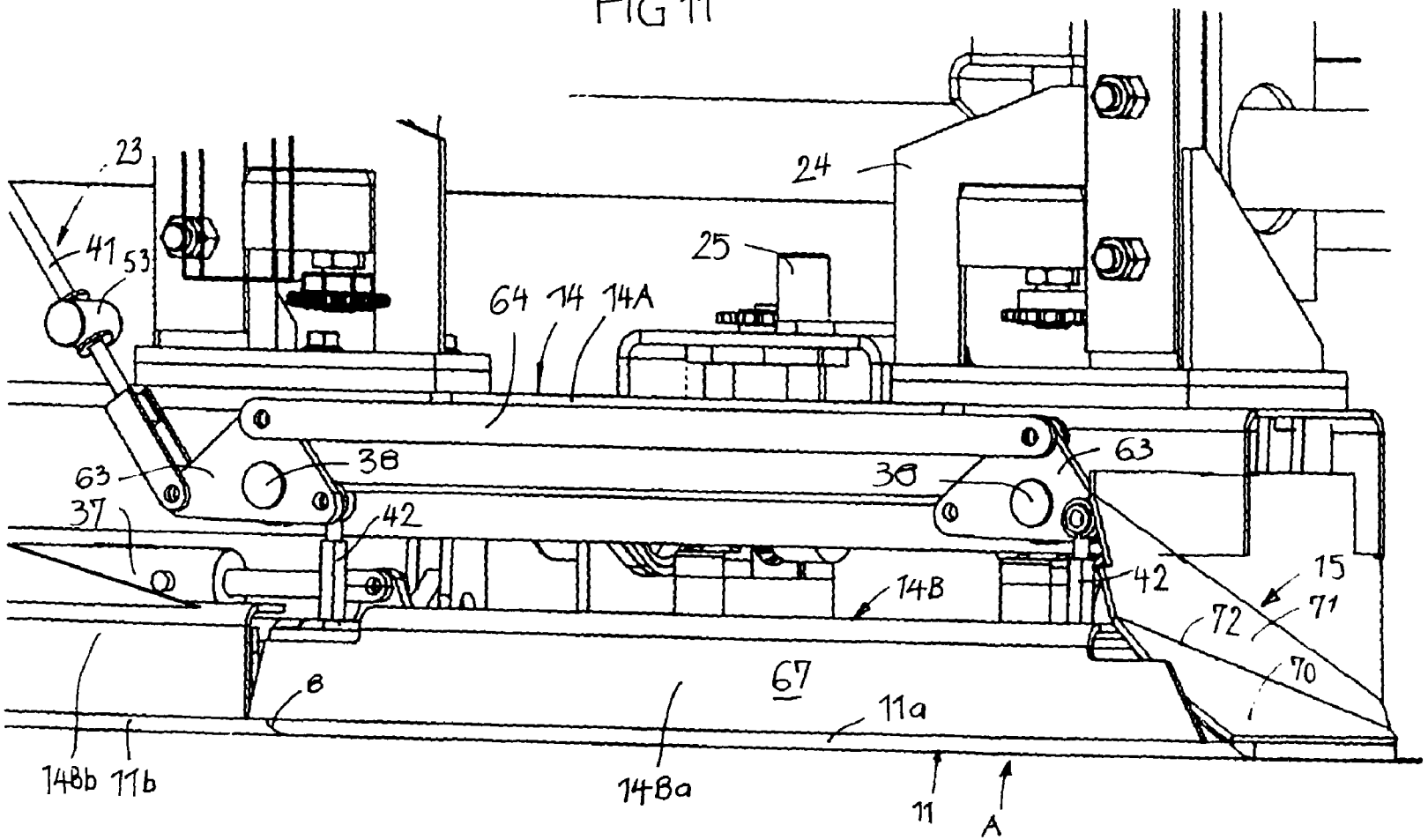

In FIGS. 11 and 13 the screw spindle 41 lower end below the nut body 53 engages at a triangular rotary part 63 rotatably supported in the bearing location 38 in the upper frame 14A. The triangular rotary part 63 is coupled by a link 64 with an equally dimensioned triangular rotary part 63 rotatably supported in the other bearing location 38 in the upper frame 14A. The connecting elements 42 (already mentioned in connection with FIG. 5) are connected with the rotary bodies 63 and engage in the front region of the upper side of the frame section 14Ba or of the first inner section 11*a* of the sole plate 11. The second berm section 11*b* attached to the frame section 14Bb is connected behind the front wall 67 to the first section 11*a* by means of the berm hinge region 8. The front wall 67 serves as a scraper blade in front of the upwardly bent draw-in nose 68 (FIG. 12) of the extension screed sole plate 11. Owing to the connection between both sections 11*a*, 11*b* by the berm hinge region 8 the second berm section 11*b* respectively will form the same attack angle with the planum as set by the screw spindle 41 for the first section 11*a*. Via the connections elements 42 the first section 11*a* either is pivoted or is bent about the hinge axis 65 situated at the rear end edge of the extension screed sole plate 11, and relative to the upper frame 14A.

An actuator 37, e.g. a hydro-cylinder, shown in FIGS. 5, 6 and 11 and 13, is linked to the upper side of the second berm section 11*b* or the frame section 14Bb. The actuator 37 bridges the berm hinge region 8 and is connected with the other frame section 14Ba. The actuator 37 positions the second berm section 11*b* either as shown in FIG. 5 parallel and in alignment to the first section 11*a* (for producing either a slope 4 or no slope 4 without a berm 5, as in FIGS. 1 and 2), or with the berm angle β (FIG. 2) in relation to the first inner section 11*a*, e.g. at a predetermined end position, as indicated in FIG. 8, in order to produce a berm 5. In the position of FIG. 8 the outer end of the second berm section 11*b* is moved upwardly also in relation to the end gate 9. The linking point of the actuator 37 at the frame section 14Ba is highlighted in FIG. 8 at 57.

The extension screed sole plate 11 and/or the lower frame 14B alternatively could respectively be integral or one piece, as the possibility to also produce a berm 5 only is an expedient option of the paving screed E. As well the attack angle adjustment device 23 may be an optional equipment of the paving screed E. The screw spindle 41 alternatively could be replaced by other suitable actuators like e.g. a hydraulic cylinder, an electro-spindle drive, or the like. Furthermore, it is possible to arrange the actuator 37 and connections elements at the upper frame 14A and to adjust the frame section 14Bb of the lower frame 14B, e.g. when producing a berm 5, from the upper frame 14A.

As a further optional equipment the sole plate attack angle of the paving screed A can be varied relative to the connection beams 3' by means of an attack angle adjustment device according to FIGS. 5 and 7, without the necessity to displace the towing points 1 (FIG. 1) of the tow bars 2 in vertical direction. For this function each connection beam 3', which carries a connection plate 52 for attaching and end of a tow bar 2, is pivotable about an axis 47 (FIG. 7) in the base screed G. The axis 47 (FIG. 7) extends at least substantially parallel to the sliding direction Z. A vertical beam 49 fixed to the base screed G extends adjacent to the connection beam 3'. An actuator 48 is provided between the connection beam 3' and the vertical beam 49 for individually setting the attack angle of the sole plate 10 of the base screed G and as well the base screed G relative to the planum P, and relative to the connection beam 3' fixedly connected with the tow bar 2. A functionally similar sole plate attack angle adjustment device alternatively could be arranged directly between the tow bar 2 and the connection beam 3' or the connection plate 52 (not shown).

A further optional equipment of the frontmost paving screed E is a plough structure 15 (FIGS. 3, 5 and 12) situated at the respective inner end of each extension screed A. The task of the plough structure 15 is to peel off paving material forwards on the planum P which is present in front of the base screed G and in front of the inner ends of the extension screeds A when one or both of the extension screeds A are retracted to each other, and to shovel the peeled off paving to the base screed sole plate 10 which then works this paving material into the roadbed M, until both extension screeds A finally will be positioned adjacent to each other in the middle of the base screed G. The plough structures 15 prevent that paving material will be clamped between both extension screeds A and hinders to maximally reduce the working width.

The plough structure 15 (FIGS. 5 and 12) starts at the bottom at an inner edge section 69 of the extension screed sole plate 11 (first section 11*a*) which inner edge section 69 is substantially parallel to the working travelling direction R. A first repelling surface 17 ascends from the inner edge section 69 obliquely upwardly and outwardly. A second, substantially vertical repelling surface 71 continues the first repelling surface 70 along an obliquely extending line 72 of intersection. The line 72 of intersection of both repelling surfaces 70, 71 starts in working travelling direction R in the front at a higher position of the first repelling surface 70 and extends obliquely downwardly to a lower position at the first repelling surface 70. The second repelling surface 71 has its rear edge at the rear end of the inner edge section 69, seen in working travelling direction R, and extends from this location in working travelling direction R obliquely outwardly. The plough structure 15 may additionally be supported by the frame section 14Ba of the lower frame 14B.

Alternatively, the plough structure 15 can be constituted by a one piece sheet metal part bent with a curvature. Furthermore, a one piece sheet metal part of the plough structure 14 may have several lines of intersections between several repelling surfaces or bending edges like the line of intersections at 72, such that the plough structure 15 is subdivided in an arbitrary plurality of partial segments (not shown) similar to the first and second repelling surfaces 70 and 71.

In FIG. 6 (in viewing direction in working travelling direction R from the rear side) the first linear actuator 19 has retracted the guiding sub-structure 17 relative to the base guiding structure 18 through the first stroke H1, while the extension guiding structure 16 is held by the second linear actuator 29 in the sliding position shown in FIG. 3 on the guiding sub-structure 17. The extension screed A is only partially extended. A slope angle $\alpha=0°$ is set (flat road surface 3). In order to move the extension screed E into the fully retracted position according to FIG. 12, the second linear actuator 29 pulls the extension guiding structure 16 from the position shown in FIG. 4 until the upper vertical plate 13 is located adjacent to the upper end plate 32 of the guiding sub-structure 17, according to FIG. 12. The width of the guiding sub-structure 17 in sliding direction Z corresponds substantially to the inner width of the extension screed A, while the width of the extension guiding structure 16 including the vertical plates 13 in sliding direction Z e.g. is only slightly larger than half of the inner width of the extension screed A. By this relative dimensioning the additional large second stroke H2 is achieved between the guiding sub-structure 17 and the extension guiding structure 16. Owing to the large width of the guiding sub-structure 17 in sliding direction Z and in relation to the guiding support length of the base guiding structure 18 the relatively long first stroke H1 is achieved.

As conventional, heating equipments and vibration equipments or the like may be contained in both the base screed G and the extension screeds A.

Figure 9:
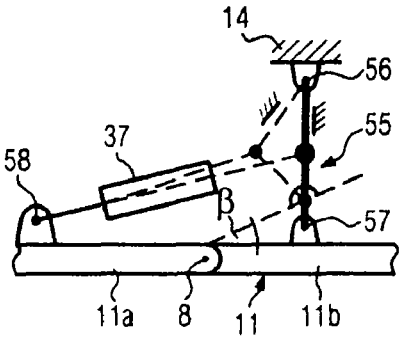

FIG. 9 schematically illustrates a detail variant in which the actuator 37 for setting the berm angle β, which actuator 37 is linked at 58 e.g. to the first section 11A or to the frame section 14Ba, does not directly engage at the second berm section 11*b* but at an elbow mechanism 55 which is linked to a pivot bearing 57 in the frame section 14Bb or the second berm section 11*b* and in a support 57 at the upper frame 14A. There might exist, as indicated, stationary stops defining two extreme positions of the elbow lever mechanism 55. For example, when the elbow lever mechanism 55 is fully stretched, the second berm section 11*b* is aligned in the berm hinge region 8 with the first section 11*a* (no berm 5 is formed). In the second, bent extreme position defined by another stop the berm section 11*b* is pivoted to form the angle β (a berm 5 is formed in the roadbed M).

Figure 10:
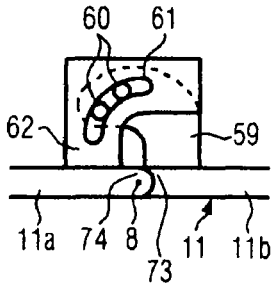

FIG. 10 illustrates schematically as a further option a concept of the berm hinge region 8 between the sections 11*a*, 11*b* of the extension screed sole plate 11. One end edge 74 of the first section 11*a* e.g. is convexly rounded following the arc of a circle. To the contrary, an end edge 73 of the second berm section 11*b* is concavely rounded following as well an arc of a circle having at least substantially the same radius. The end edges 73, 74 are inter-engaging with a precise form-fit such that no gap will be opened at the lower side of the extension screed sole plate 11, when the second berm section 11*b* is pivoted (angle β). Such a gap otherwise would form an undesirable crest in the road surface 3 of the roadbed M.

In order to stabilise the pivot motions between the inter-engaging end edges 73, 74 in the berm hinge region 8, and to support the sections 11*a*, 11*b*, furthermore, at least at one position of the berm hinge region 8 guiding elements 59, 62 each following a part of an arc of a circle are attached to the upper sides of the sections 11*a*, 11*b* or to the frame sections 14Ba, 14Bb. The guiding elements 59, 62 have at least one lateral bolt 60 and an arc-shaped guiding slot 61, in order to achieve a guiding function and a supporting function which is concentric to the hinge axis in the berm hinge region 8. Preferably, there are several pairs of guiding elements 59, 62 distributed along the extension of the berm-hinge region 8.

FIGS. 3, 5, 6 and 12 finally show a crown profile adjustment device 37 (FIG. 3) as an optional equipment of the base screed G. The base screed G (two base screed parts) is adjustable in the middle part about an axis 74 of the base screed sole plate 10, in order to form a crown profile. The axis 74 extends parallel to the working travelling direction R. The crown profile adjustment device 33 (FIG. 3) is operating functionally between two base screed parts. In the case as shown the sole plate 10 continues e.g. over the axis 74 without an interruption and is only bent thanks to its elasticity, when the base screed halves are adjusted for a crown profile. The conventional draw-in nose 76 (which can be seen in the rear view of FIG. 6) upwardly bent at the front edge of the sole plate 10 e.g. is interrupted at a V-shaped cut-out 75 in order to facilitate bending and returning the plate-shaped sole plate 10.

Alternatively, the sole plate 10 could consist of two parts. Then the axis 74 may be defined by a crown profile hinge between the base screed parts or base screed sole plate parts.

The invention claimed is:

1. A paving screed for a road paver comprising a base screed and at least one extension screed which is provided at the base screed offset in a working travelling direction and which is extendable and retractable relative to the base screed in a linear sliding direction, a pivotable base guiding structure for the extension screed, a guiding sub-structure that is guided in the base guiding structure and at least a first actuator for sliding the guiding sub-structure over a first stroke relative to the base guiding structure, an extension guiding structure guided in the guiding sub-structure, and at least a second actuator for sliding the extension guiding structure over a second stroke relative to the guiding sub-structure, a sole plate frame structure mounted to the extension guiding structure and having an extension screed sole plate, vertical guidances, and elevation adjustment assemblies extending in a substantially vertical direction in relation to the sliding direction, for adjusting the elevation of the sole plate frame structure parallel to itself and relative to the base guiding structure, the base guiding structure being supported in the base screed by a slope hinge having a hinge axis extending at least substantially parallel to the working travelling direction of the paving screed, the slope hinge defining a pivot support for the base guiding structure, the at least one actuator anchored to the base screed engages with the base guiding structure at a distance from the slope hinge, and the extension screed is located at the front side of the base screed, and wherein the slope hinge is arranged closer to an end of the base screed connected to the extension screed than the first actuator.

2. A paving screed according to claim 1, wherein the base guiding structure comprises a plate frame containing two parallel guiding tubes.

3. A paving screed according to claim 1, wherein the guiding sub-structure comprises two first parallel guiding elements fixed between end plates, the first guiding elements being slidably guided in guide tubes positioned on the base guiding structure, and two second guiding elements fixed between the end plates, the second guiding elements being offset with respect to the first guiding elements and being parallel to the first guiding elements.

4. A paving screed according to claim 1, wherein the extension guiding structure comprises two spaced apart vertical plates extending perpendicular to the sliding direction and two parallel guiding tubes fixed between the vertical plates, the parallel guiding tubes being slidably guided on the second guiding elements of the guiding sub-structure.

5. A paving screed according to claim 2, wherein the guiding tubes of the base guiding structure and the first guiding elements are substantially horizontal, and the guiding tubes of the extension guiding structure and the second guiding elements are situated substantially vertical above each other.

6. A paving screed according to claim 1, wherein the elevation adjustment assemblies are supported at one end at the extension guiding structure and at the opposite end at the sole plate frame structure, and that the vertical guidances are located at vertical plates of the extension guiding structure.

7. A paving screed according to claim 6, wherein the vertical guidances comprise slots in guiding bodies for the sole plate frame structures, the slots being penetrated by a plurality of guiding bolts.

8. A paving screed according to claim 1, wherein the elevation adjustment assemblies comprise two screw spindles which are threadably received in spindle blocks fixed at least at the extension guiding structure, that the screw spindles are rotatably secured in blocks fixed in the sole plate frame structure, and that a common drive, is associated to both screw spindles.

9. A paving screed according to claim 1, wherein the extension screed sole plate is divided into a first inner section connected to an upper frame of the sole plate frame structure and into an outer second berm section which is pivotable in relation to the upper frame in the berm hinge region.

10. A paving screed according to claim 9, wherein at least one berm angle adjustment actuator is arranged on the extension screed sole plate.

11. A paving screed according to claim 10, wherein the berm angle adjustment actuator comprises a hydro-cylinder or a screw spindle.

12. A paving screed according to claim 1, wherein the extension screed sole plate and a lower frame of the sole plate frame structure are tiltably supported for individually adjusting an attack angle of the sole plate of the extension screed about a hinge axis extending substantially parallel to the sliding direction, and an attack angle adjustment device supported at the sole plate frame structure and at least engaging at a first inner section of the extension screed sole plate.

13. A paving screed according to claim 12, wherein the attack angle adjustment device comprises a screw spindle which is threadably received in a nut body situated in the upper frame of the sole plate frame structure, the screw spindle engages at a gear mechanism supported in the upper frame, and the gear mechanism is coupled at least with the first inner section of the extension sole plate or an inner section of the lower frame of the sole plate frame structure.

14. A paving screed according to claim 9, wherein in the berm hinge region a convexly rounded end edge of one section of the first and second sections engages into a concavely rounded end edge of the other section, and that inter-engaging guiding parts with the shape of an arc of a circle are arranged at both first and second sections or the first and second sections of the lower frame for supporting the berm hinge region.

15. A paving screed according to claim 1, wherein a plough structure is provided at an end of the extension screed sole plate facing to the base screed, the plough structure being defined by an edge section of the sole plate, the edge section extending substantially parallel to the working travelling direction, by a first inclined repelling surface extending from the end section upwardly and outwardly, and by at least one second, substantially vertical repelling surface continuing the first repelling surface, the second repelling surface extending counter to the working travelling direction and obliquely outwardly, such that the repelling surfaces either intersect each other with obtuse angles or are incorporated into a curvature.

16. A paving screed according to claim 1, wherein a first horizontal actuator is arranged in the base screed and engages at a plate frame of the base guiding structure and at an end plate of the guiding sub-structures, and a second horizontal actuator is arranged between the plate frame of the base guiding structure and one vertical plate of the extension guiding structure.

17. A paving screed according to claim 3, wherein the two first guiding elements and one of the two second guiding elements of the guiding substructure are provided at least substantially in a common horizontal plane.

* * * * *